US006634327B2

(12) United States Patent
Yanai

(10) Patent No.: US 6,634,327 B2
(45) Date of Patent: Oct. 21, 2003

(54) APPARATUS AND METHOD FOR DETECTING CHANGE OF NEUTRAL POSITION OF VALVE OF ELECTROMAGNETIC VALVE ACTUATION SYSTEM, AND APPARATUS AND METHOD FOR CONTROLLING THE VALVE

(75) Inventor: Akihiro Yanai, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/151,997

(22) Filed: May 22, 2002

(65) Prior Publication Data

US 2002/0185089 A1 Dec. 12, 2002

(30) Foreign Application Priority Data

Jun. 8, 2001 (JP) ..... 2001-173328

(51) Int. Cl.[7] ..... F01L 9/04

(52) U.S. Cl. ..... 123/90.11; 123/90.15; 251/129.15

(58) Field of Search ..... 123/90.11, 90.15, 123/90.17; 251/129.15, 129.16, 129.18, 129.01, 129.02

(56) References Cited

U.S. PATENT DOCUMENTS 4,829,947 A * 5/1989 Lequesne ..... 123/90.11
5,636,601 A * 6/1997 Moriya et al. ..... 123/90.11
6,047,672 A * 4/2000 Hanai et al. ..... 123/90.11
6,170,445 B1 1/2001 Hattori et al.
6,378,473 B2 * 4/2002 Yamaki et al. ..... 123/90.11

FOREIGN PATENT DOCUMENTS

JP A 2000-8894 1/2000
JP A 2000-161032 6/2000

* cited by examiner

*Primary Examiner*—Thomas Denion
*Assistant Examiner*—Ching Chang
(74) *Attorney, Agent, or Firm*—Oliff & Berridge, PLC

(57) ABSTRACT

A valve is urged in the valve-opening direction by an upper spring and in the valve-closing direction by a lower spring. The valve is thus urged to a neutral position where the respective urging forces are balanced. The valve is controlled to be released from one of two terminal positions, that is, the full-open position or the full-closed position, and to be attracted to the position from which the valve has been released. The displacement pattern of the valve during this period is sensed by a displacement amount sensor, whereby the maximum displacement amount of the valve from that terminal position is measured. The change of the neutral position is detected based on the change of the measured maximum displacement amount with respect to a reference value.

20 Claims, 5 Drawing Sheets

APPARATUS AND METHOD FOR DETECTING CHANGE OF NEUTRAL POSITION OF VALVE OF ELECTROMAGNETIC VALVE ACTUATION SYSTEM, AND APPARATUS AND METHOD FOR CONTROLLING THE VALVE

INCORPORATION BY REFERENCE

The disclosure of Japanese Patent Application No. 2001-173328 filed on Jun. 8, 2001, including the specification, drawings and abstract is incorporated herein by reference in its entirety.

BACKGROUND OF THE INVENTION

1. Field of Invention

The invention relates to an apparatus and method for detecting a change of a neutral position of a valve of an electromagnetic valve actuation system which is caused by e.g., aging of the electromagnetic valve actuation system, and an apparatus and method for controlling the valve. The electromagnetic valve actuation system to which the invention drives a valve such that the valve is placed in an open position and a closed position by an electromagnetic force of an electromagnet, and the valve is urged to a neutral position by urging forces of urging members for urging the valve in the valve-opening and valve-closing directions. The neutral position is a position where the urging forces are balanced.

2. Description of Related Art

For drive control of the electromagnetic valve actuation system, not only is assuring operation stability of the electromagnetic valve actuation system important, but also minimizing power consumption and suppressing noise generated by opening and closing the valve are also important in terms of the performance of the electromagnetic valve actuation system. Therefore, various efforts have been made to satisfy the above requirements. For example, a current is supplied to the electromagnet according to a current supply pattern that is preset so that the requirements can be satisfied.

However, if the neutral position is changed due to aging and the like, drive control of the electromagnetic valve actuation system (such as the current supply pattern to the electromagnet) becomes inappropriate. For example, an insufficient electromagnetic force would degrade the ability to reliably hold the valve at the full-closed position or full-open position, and excessive electromagnetic force would increase the noise generated when the valve is seated on a valve seat.

In view of the above problems, for example, Japanese Patent Laid-Open Publication No. 2000-8894 proposes detecting the change of the neutral position of the valve based on a lifted position when the electromagnet does not generate the electromagnetic force and the valve stands still at the neutral position, and correcting the current supply pattern based on the detection result.

In the case of an electromagnetic valve actuation system whose valve may stand still at the neutral position, it is possible to detect the change of the neutral position by the method described in the above publication. As described in Japanese Patent Laid-Open Publication No. 2000-161032, however, some electromagnetic valve actuation systems have a valve which does not stand still at the neutral position and is held at the open position or closed position even when the engine is stopped. In such an electromagnetic valve actuation system, the change of the neutral position cannot be known by the aforementioned method. Therefore, the above detecting method is still problematic in view of versatility.

SUMMARY OF THE INVENTION

The invention thus accurately detects a change of a neutral position of a valve in an electromagnetic valve actuation system having a valve that does not stand still at the neutral position. Also the invention also provides control of the valve based on the result of the detection.

A first aspect of the invention relates to an apparatus for detecting a change of a neutral position of a valve of an electromagnetic valve actuation system. In the first aspect of the invention, the apparatus for detecting the change of the neutral position is applied to the electromagnetic valve actuation system having the valve that is urged to the neutral position by urging forces of urging members for urging the valve in valve-opening and valve-closing directions. The neutral position is a position where the urging forces are balanced. The apparatus includes an electromagnet that drives the valve in the valve-opening and the valve-closing directions by an electromagnetic force and a controller that releases the valve held at one of a first terminal position in a closed position side and a second terminal position in an open position side, e.g., a full-closed position or a full-open position, and then attracts the valve to one of the terminal positions by supplying a current to the electromagnet, and that detects the change of the neutral position based on a parameter that represents a displacement pattern of the valve obtained by displacing the valve.

In the above structure, the valve, which is held at one of the first terminal position and the second terminal position, e.g., the full-closed position or the full-open position, is released and then attracted to one of the terminal positions by supplying the current to the electromagnet. The change of the neutral position is detected based on the parameter that represents the displacement pattern of the valve obtained by displacing the valve. The above structure thus enables implementation of a versatile apparatus that is capable of detecting the change of the neutral position of the valve of the electromagnetic valve actuation system even when the valve does not stand still at the neutral position. The displacement pattern of the valve changes depending on whether the neutral position is changed. Therefore, the change of the neutral position can be detected by measuring the parameter representing the displacement pattern of the valve.

A second aspect of the invention relates to a method for detecting a change of a neutral position of a valve of an electromagnetic valve actuation system. The method includes a first step of releasing the valve held at one of a first terminal position in a closed position side and a second terminal position in an open position side, and then attracting the valve to one of the terminal positions by supplying a current to an electromagnet of the electromagnetic valve actuation system, a second step of measuring a parameter that represents a displacement pattern of the valve obtained by displacement of the valve; and a third step of detecting the change of the neutral position based on the measured parameter in the second step.

BRIEF DESCRIPTION OF THE DRAWINGS

The foregoing and further objects, features and advantages of the invention will become apparent from the following description of preferred exemplary embodiments with reference to the accompanying drawings, wherein like numerals are used to represent like elements and wherein.

DETAILED DESCRIPTION OF PREFERRED EMBODIMENTS

First Exemplary Embodiment

Hereinafter, an apparatus for detecting a change of a neutral position of a valve of an electromagnetic valve actuation system according to the first exemplary embodiment of the invention will be described with reference to the accompanying drawings. The first exemplary embodiment detects a change of a neutral position of an engine valve in an internal combustion engine. Note that intake and exhaust valves as engine valves basically have the same structure and are basically driven according to the same drive control pattern. Therefore, the exhaust valve will be herein exemplarily described as the engine valve.

The exhaust valve is urged in the valve-closing direction by a first urging member and is urged in the valve-opening direction by a second urging member. The urging forces of the first and second urging members are preset so as to be balanced when the valve is at an approximately intermediate position of the full-open position and the full-closed position. The exhaust valve includes an armature, and is electromagnetically driven in response to an electromagnetic force applied to the armature. The exhaust valve further is held by a holding device for holding the exhaust valve to either a terminal position of the valve-opening direction (i.e., full-open position) or a terminal position of the valve-closing direction (i.e., full-closed position) when no electromagnetic force is generated.

Figure 1:
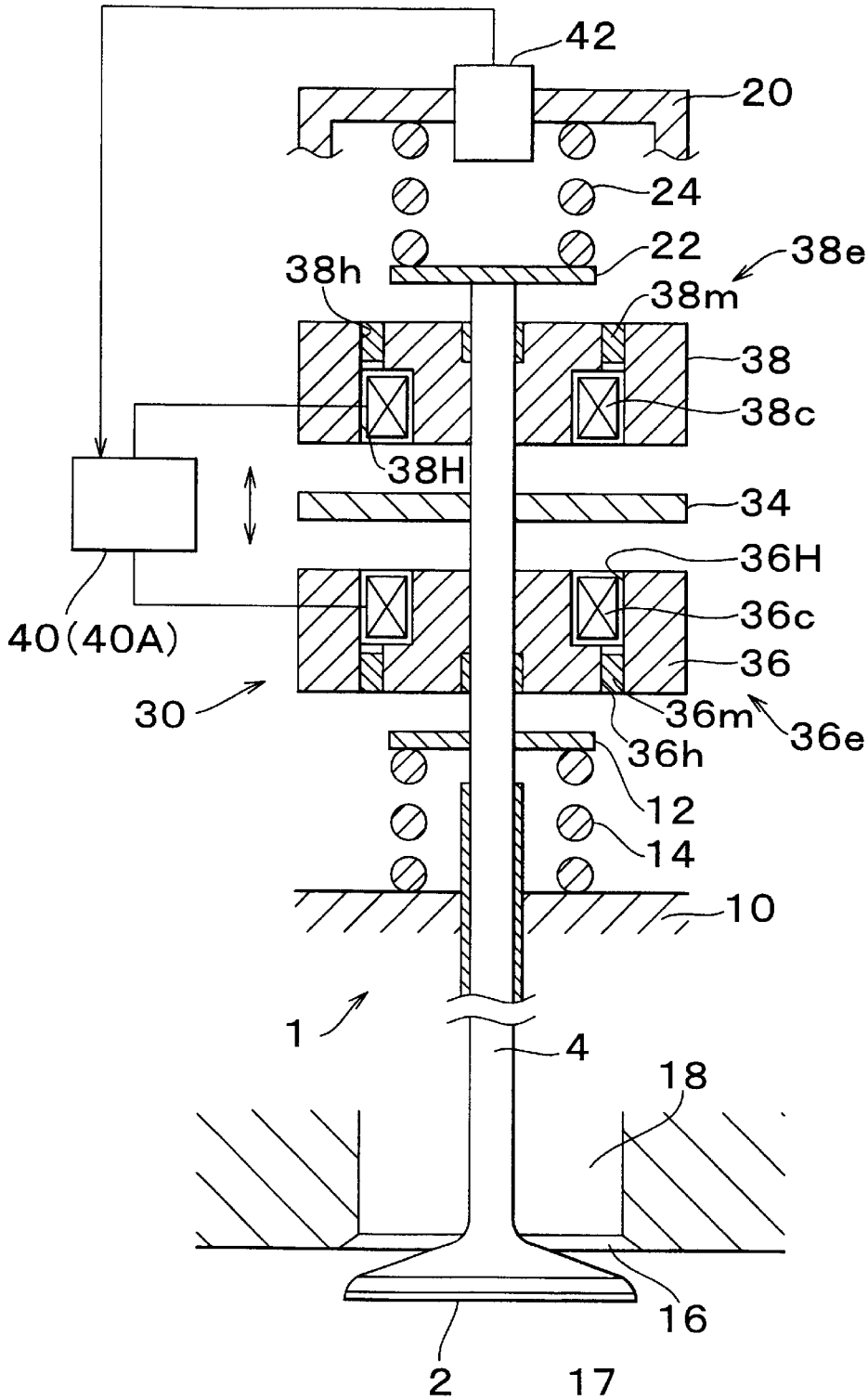
FIG. 1 shows the overall structure of an apparatus for detecting a change of a neutral position of a valve of an electromagnetic valve actuation system according to a first exemplary embodiment of the invention.

As shown in FIG. 1, the electromagnetic valve actuation system includes an exhaust valve 1, springs 14, 24, and an electromagnetic drive portion 30.

The exhaust valve 1 includes the valve shaft 4, a valve element 2 formed at one end of the valve shaft 4, an armature 34 fixed to the valve shaft 4, an upper retainer 22 and a lower retainer 12.

Respectively, the springs 14, 24 corresponds to the first and second urging members for urging the exhaust valve 1 to the neutral position. The lower spring 14 urges the exhaust valve 1 in the valve-closing direction. The upper spring 24 urges the exhaust valve 1 in the valve-opening direction.

More specifically, the valve shaft 4 has a lower retainer 12 at a position opposite to the combustion chamber 17 with respect to the cylinder head 10. The lower spring 14 is mounted in a compressed state between the lower retainer 12 and the cylinder head 10. The exhaust valve 1 is urged in the valve-closing direction by the urging force (elastic force) of the lower spring 14.

The valve shaft 4 also has an upper retainer 22 at the end opposite to the valve element 2. The upper spring 24 is mounted in a compressed state between the upper retainer 22 and an upper cap 20. The upper cap 20 is mounted within a not-shown casing of the electromagnetic driving portion 30. The valve exhaust valve 1 is urged in the valve-opening position by the urging force (elastic force) of the upper spring 24.

The electromagnetic drive portion 30 reciprocates the exhaust valve 1 in a cylinder head 10 and holds the exhaust valve 1 at the full-open position or the full-closed position when the engine is stopped.

The cylinder head 10 has an exhaust port 18 leading to a combustion chamber 17 and a valve seat 16 on which the valve element 2 is seated. The valve seat 16 is formed at the peripheral edge of the opening of the exhaust port 18. With reciprocation of the exhaust valve 1, the valve element 2 is seated on and separated from the valve seat 16, whereby the exhaust port 18 is opened and closed.

The electromagnetic driving portion 30 includes a lower core 36 and an upper core 38 that are arranged with the armature 34 interposed therebetween. The armature 34 is a disc-like member of a material having high magnetic permeability. The lower core 36 and the upper core 38 are annular members of a material having high magnetic permeability. The valve shaft 4 extends through the centers of the lower core 36 and the upper core 38 so that it can reciprocate therein.

The lower core 36 has an annular first groove 36H at the surface facing the armature 34. The first groove 36H is formed concentrically about the valve shaft 4. An annular lower coil 36*c* is mounted in the first groove 36H. The lower coil 36*c* and the lower core 36 form an electromagnet (first electromagnet) 36*e* for driving the valve element 2 in the valve-opening direction.

The lower core 36 has an annular second groove 36*h* at the surface opposite to that facing the armature 34. The second groove 36*h* is formed concentrically about the valve shaft 4. An annular permanent magnet 36*m* is mounted in the second groove 36*h*. The magnetic force of the permanent magnet 36*m* acts as an attraction between the armature 34 and the first electromagnet 36*e* (lower core 36). Therefore, when the armature 34 gets close to the first electromagnet 36*e*, the attraction attracts the armature 34 toward the lower core 36 against the urging force (elastic force) of the lower spring 14. Because of the magnetic force of the permanent magnet, the armature 34 is kept in contact with the lower core 36 even when a drive current for the first electromagnet 36*e* is small enough, or even when the drive current is zero while the engine is stopped. When the armature 34 is thus in contact with the lower core 36, the valve element 2 is located farthest away from the valve seat 16. In other words, the exhaust valve 1 is fully opened. This position of the exhaust valve 1 corresponds to the "full-open position".

The upper core 38 has an annular first groove 38H at the surface facing the armature 34. The first groove 38H is formed concentrically about the valve shaft 4. An annular upper coil 38*c* is mounted in the first groove 38H. The upper coil 38*c* and the upper core 38 form an electromagnet (second electromagnet) 38*e* for driving the exhaust valve 1 in the valve-closing direction.

The upper core 38 has an annular second groove 38*h* at the surface opposite to that facing the armature 34. The second groove 38*h* is formed concentrically about the valve shaft 4. An annular permanent magnet 38*m* is mounted in the second groove 38*h*. The magnetic force of the permanent magnet 38*m* acts as an attraction between the armature 34 and the second electromagnet 38*e* (upper core 38). Therefore, when the armature 34 gets close to the second electromagnet 38*e*, the attraction attracts the armature 34 toward the upper core 38 against the urging force of the upper spring 24. Because of the magnetic force of the permanent magnet 38*m*, the valve element 2 is kept seated on the valve seat 16 even when a drive current for the second electromagnet 38*e* is small enough, or even when the drive current is zero while the engine is stopped. When the valve element 2 is thus seated on the valve seat 16, the exhaust valve 1 is fully closed. This position of the valve element 2 corresponds to the "full-closed position".

Note that FIG. 1 shows the state where the armature 34 stands still at the neutral position (i.e., the position where the urging forces of the springs 14, 24 are balanced) without being attracted by the electromagnetic forces of the electromagnets 36*e*, 38*e*. When the armature 34 is subjected to the electromagnetic force of the first electromagnet 36*e* or the second electromagnet 38*e*, it is attracted toward the lower core 36 or the upper core 38. This electromagnetic force is generated when a current is applied to the coils 36*c*, 38*c* of the electromagnets 36*e*, 38*e*.

In the present exemplary embodiment, such current application to the coils 36*c*, 38*c* of the electromagnets 36*e*, 38*e* is controlled based on displacement of the exhaust valve 1. A displacement amount sensor 42 is mounted to the upper cap 20. The displacement amount sensor 42 outputs a voltage (detection signal) that changes according to the distance between the displacement amount sensor 42 and the upper retainer 22. The displacement amount of the upper retainer 22, that is, the displacement amount of the exhaust valve 1, can be detected based on the voltage. The use of the detection result of the displacement amount sensor 42 enables the current application to be controlled based on the displacement of the exhaust valve 1.

The current application is controlled by an electronic control unit (ECU) 40. The ECU 40 generally conducts various controls of the internal combustion engine. The ECU 40 includes a central processing unit (CPU), a memory, a driving circuit for supplying an exciting current to the coils 36*c*, 38*c* of the electromagnets 36*e*, 38*e*, an input circuit for receiving a detection signal of the displacement amount sensor 42, an analog-digital (A–D) converter for converting the detection signal from analog to digital form, and the like. All the above components of the ECU 40 are not shown in the figure.

Hereinafter, operation of the exhaust valve 1 will be described. The exhaust valve 1 is opened and closed according to the current application control by the ECU 40.

When the exhaust valve 1 is in the closed state, a holding current is supplied to the second electromagnet 38*e* in order to hold the exhaust valve 1 at the full-closed position. That is, in order to hold the valve element 2 at the seated position on the valve seat 16. The direction of the holding current is set so that the second electromagnet 38*e* generates a magnetic flux in the same direction as that of the magnetic flux generated by the permanent magnet 38*m*. When the holding current is supplied to the second electromagnet 38*e*, the armature 34 is subjected to the resultant force of the electromagnetic force of the second electromagnet 38*e* and the magnetic force of the permanent magnet 38*m*. This resultant force causes the armature 34 to be attracted toward the upper core 38 against the urging force of the upper spring 24. This attraction allows the valve element 2 to be kept seated on the valve seat 16 against the urging force of the upper spring 24.

At the timing of driving the exhaust valve 1 in the valve-opening direction, supply of the holding current is discontinued and a release current is supplied to the second electromagnet 38*e*. The direction and magnitude of the release current are set so that the release current can overcome the magnetic force generated by the permanent magnet 38*m*. The armature 34 is thus moved toward the lower core 36, and the valve element 2 is separated from the valve seat 16 toward the combustion chamber 17.

When the exhaust valve 1 is displaced by a prescribed amount or more, supply of the release current to the second electromagnet 38*e* is discontinued. The exhaust valve 1 is then further displaced in the valve-opening direction by the inertial force of the exhaust valve 1 and the urging force of the upper spring 24.

When the exhaust valve 1 is displaced by a prescribed amount or more from the full-closed position toward the full-open position, an attracting current is supplied to the first electromagnet 36*e*. When the exhaust valve 1 reaches the full-open position, a holding current is supplied to the first electromagnet 36*e* in order to hold the exhaust valve 1 at the full-open position. In response to the holding current, the first electromagnet 36*e* generates electromagnetic force. The resultant force of the electromagnetic force of the first electromagnet 36*e* and the magnetic force of the permanent magnet 36*m* holds the exhaust valve 1 at the full-open position against the urging force of the lower spring 14.

When the exhaust valve 1 is driven in the valve-closing direction into the full-closed position, current supply to the first and second electromagnets 36*e*, 38*e* is selectively controlled in the same manner as that in the case where the exhaust valve 1 is driven in the valve-opening direction from the full-closed position to the full-open position.

When the internal combustion engine is stopped, the exhaust valve 1 is driven at the same timing as that in the normal control until the exhaust valve 1 reaches either the full-closed position or the full-open position. After the exhaust valve 1 is held either at the full-closed position or the full-open position, current supply to the first electromagnet 36*e* and the second electromagnet 38*e* is discontinued. The exhaust valve 1 is thus held either at the full-open position or the full-closed position by the magnetic force of either the permanent magnet 36*m* or 38*m* that is applied to the armature 34.

In the exhaust valve 1 that is driven in the aforementioned manner, the neutral position, i.e., the position where the respective urging forces of the lower spring 14 and the upper spring 24 are balanced, is changed due to aging or the like. Such the change of the neutral position renders the drive control of the exhaust valve 1 (e.g., magnitude of the holding current and release current that are applied to the electromagnets 36*e*, 38*e*, and timing of applying the same) inappropriate. It is therefore desirable to detect the change of the neutral position and change the setting for the drive control of the exhaust valve 1 according to the detected displacement. It should be noted that, according to the above drive control of the exhaust valve 1, the exhaust valve 1 does not stand still at the neutral position. It is therefore impossible to directly detect the neutral position.

In view of this, the following two processes are conducted in the present exemplary embodiment:

(A) The exhaust valve 1, held at either the full-open position or the full-closed position, is released and then attracted to either the full-open position or the full-closed position; and (B) The change of the neutral position, where the respective urging forces of the lower spring 14 and the upper spring 24 are balanced, is detected based on a displacement pattern of the released exhaust valve 1.

By detecting the displacement pattern of the exhaust valve 1 according to the above processes, the change of the neutral position can be detected even when the exhaust valve 1 does not stand still at the neutral position where the respective urging forces of the lower spring 14 and the upper spring 24 are balanced. In other words, the displacement pattern of exhaust valve 1 changes depending on whether the neutral position is changed. Accordingly, the change of the neutral position is obtained by detecting the displacement pattern of the valve element 2. Note that, displacement detection in the process (B) is conducted on the same conditions by presetting a current supply pattern of the process (A) (e.g., a prescribed command current (a prescribed waveform that defines the relation of electromagnetic force to time)) at least during the detection process (B).

In the present exemplary embodiment, the exhaust valve 1, held at either the full-open position or the full-closed position, is first released and then attracted back to that position. The change of the neutral position is detected based on the displacement pattern of the exhaust valve 1 at this time. More specifically, the maximum displacement amount of the exhaust valve 1 from the position where the exhaust valve 1 was held before being released is measured as a parameter representing the displacement pattern of the exhaust valve 1. It is determined whether the maximum displacement amount changes from the maximum displacement amount in the case where the neutral position is not changed, on the basis of the measured maximum displacement. The change of the neutral position is detected based on the determined change. Such detection of the change of the neutral position is conducted when the internal combustion engine is stopped. This prevents the displacement pattern of the exhaust valve 1 from varying depending on the operating state of the engine, and improves detection accuracy of the change of the neutral position.

Hereinafter, a method for detecting the change of the neutral position according to the present exemplary embodiment will be described with reference to FIGS. 2A to 2C. Note that, in the case where the exhaust valve 1 is held at the full-closed position when the engine is stopped or the exhaust valve 1 is held at the full-open position when the engine is stopped, the change of the neutral position is detected in the same manner. Therefore, the following description will be given for the case where the exhaust valve 1 is held at the full-closed position.

It is herein assumed that the exhaust valve 1 is held at the full-closed position when the engine is stopped. In this case, a release current (current pulse) is supplied to the second electromagnet 38*e* of FIG. 1 in order to release the armature 34 from the magnetic force of the permanent magnetic 38*m* that attracts the armature 34 toward the upper core 38 (FIG. 2B). The release current is supplied according to a prescribed preset supplying pattern. The armature 34 (the exhaust valve 1) is thus displaced in the valve-opening direction by the urging force of the upper spring 24. After the maximum displacement amount of the exhaust valve 1 from the full-closed position is detected, an attracting current is supplied to the second electromagnet 38e (FIG. 2B) in order to attract the exhaust valve 1 back to the full-closed position. The exhaust valve 1 is thus held at the full-closed position.

Figure 2A:
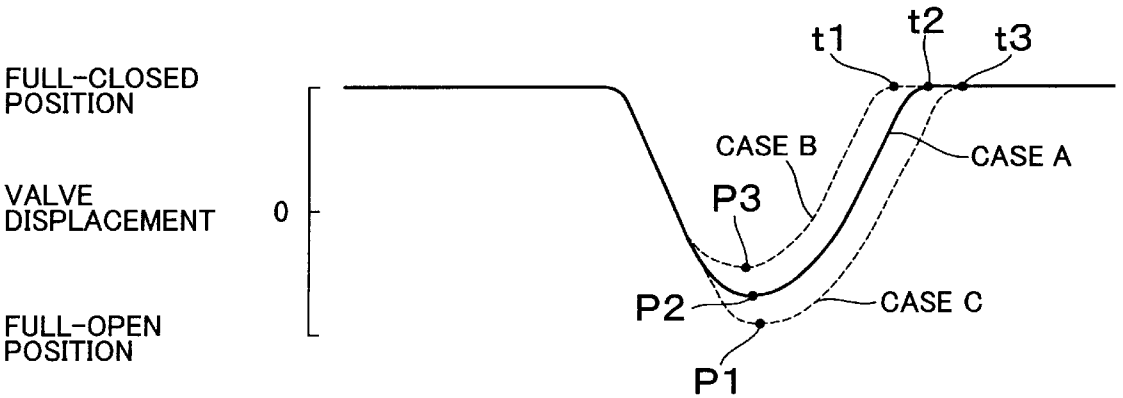
FIG. 2A exemplarily shows a displacement pattern of the valve that is obtained to detect the change of the neutral position of the valve in the first exemplary embodiment.
Figure 2B:
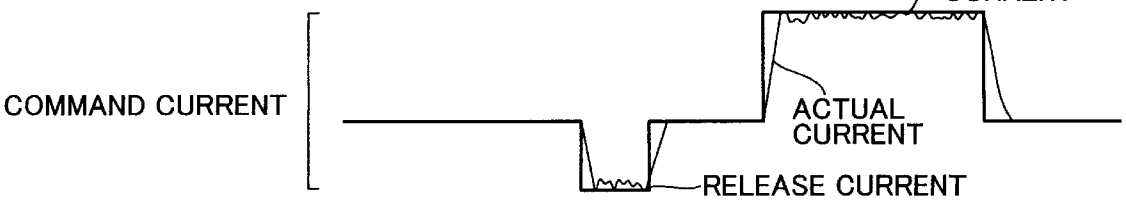
FIG. 2B shows a command current supplied to an electromagnet in order to drive the valve in the valve-closing direction to detect the change of the neutral position of the valve in the first exemplary embodiment.
Figure 2C:
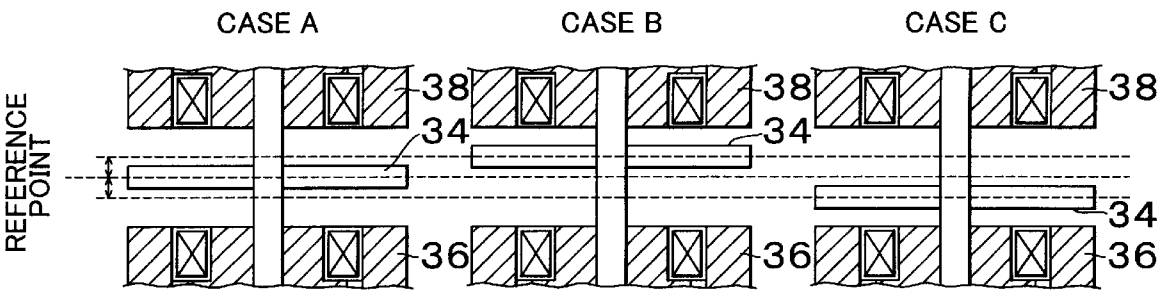
FIG. 2C exemplarily shows a valve at an initial neutral position, a valve having a neutral position changed from the initial neutral position in the valve-closing direction, and a valve having a neutral position changed from the initial neutral position in the valve-opening direction.

Of the valve displacement curves in FIG. 2A, the curve of Case A (see FIG. 2C) shown by solid line represents valve displacement that would occur when the neutral position is not changed. The curve of Case B (see FIG. 2C) shown by dashed line represents valve displacement that would occur when the neutral position is changed in the valve-closing direction. The curve of Case C (see FIG. 2C) shown by dashed line represents valve displacement that would occur when the neutral position is changed in the valve-opening direction. As can be seen from the curves, if the neutral position is changed, the valve displacement pattern changes from the valve displacement pattern obtained when the neutral position is not changed.

In particular, the maximum displacement amount from the full-closed position also changes similarly. In the present exemplary embodiment, an initial value of the detected maximum displacement amount (reference value) is defined as P2, and the change of the neutral position is detected according to the difference from the initial value P2. Note that the initial value P2 is obtained by any of the following methods:

According to a first method, the maximum displacement amount that would be obtained when the neutral position is not changed is preset for each model, and pre-stored in the memory of the ECU 40. Either values actually detected using samples or a calculated value may be used as the maximum displacement amount.

According to a second method, the initial maximum displacement amount from the full-closed position is detected for every individual valve, and pre-stored in, e.g., a backup memory.

Hereinafter, the process of detecting the change of the neutral position according to the present exemplary embodiment will be described with reference to FIG. 3. For example, this process may be repeatedly conducted at prescribed intervals.

In the series of processes, whether the engine is stopped is determined in step 100. This step corresponds to determining when an instruction to stop the internal combustion engine (e.g., to turn OFF an ignition switch) is given. If YES in step 100, it is determined that the change of the neutral position is to be detected. The routine then proceeds to step 110.

In step 10, after the exhaust valve 1 is held either at the full-open position or the full-closed position when the engine is stopped as described above, a release current is supplied to one of the two electromagnets corresponding to that position in order to release the exhaust valve 1 therefrom. As the exhaust valve 1 is displaced in response to the release current, the displacement amount sensor 42 shown in the figure detects the maximum displacement amount of the valve (step 120). For example, the maximum displacement amount may be detected by sampling the valve displacement at prescribed intervals. More specifically, when the detected valve displacement is smaller than the previous detected value, this previous detected value is used as the maximum displacement amount. As another method, a peak hold circuit may be mounted in the ECU 40 of FIG. 1 in order to detect the maximum displacement amount. More specifically, the peak hold circuit detects the maximum displacement amount based on the monitoring data of the valve displacement by the displacement amount sensor 42.

After the maximum displacement amount is thus detected, the change of the neutral position is detected based on the change of the detected maximum displacement amount with respect to the initial value (step 130). When the change of the neutral position is detected, the detection result is stored in the ECU 40, and the setting for the drive control of the exhaust valve 1 (such as the above attracting current) is varied based on the stored detection result.

The following effects are obtained according to the present exemplary embodiment:

(1) The exhaust valve 1 is first released from either the full-closed position or the full-open position, and the change of the neutral position is detected based on the maximum displacement amount of the released exhaust valve 1. This enables the change of the neutral position to be known even when the exhaust valve 1 does not stand still at the neutral position;

(2) The exhaust valve 1 is driven according to a preset drive control pattern (such as a command current to be supplied to the electromagnet) until the displacement pattern of the exhaust valve 1 is detected. This enables every detection operation to be conducted on the same conditions;

(3) The change of the neutral position is detected based on the change of the detected maximum displacement amount with respect to the initial value. This enables detection to be conducted with a simple setting; and (4) The change of the neutral position is detected when the engine is stopped. This suppresses change in displacement pattern of the valve due to other factors including an operating state of the engine, and enables accurate detection of the change of the neutral position.

Second Exemplary Embodiment

Hereinafter, an apparatus for detecting a change of a neutral position of a valve of an electromagnetic valve actuation system according to the second exemplary embodiment of the invention will be described with reference to the accompanying drawings. The second exemplary embodiment will be described mainly for the differences from the first exemplary embodiment.

In the first exemplary embodiment, the exhaust valve 1 held at either the full-closed position or the full-open position is first released, and the change of the neutral position is then detected based on the maximum displacement amount of the exhaust valve 1.

In the second exemplary embodiment, the exhaust valve 1 held at either the full-open position or the full-closed position is first released and then attracted back to that position. The neutral position is detected based on the time required for the exhaust valve 1 to return to the original position, i.e., the position where the exhaust valve 1 was held before being released, after being released (hereinafter, this time is sometimes simply referred to as "required time").

More specifically, the change of the detected required time with respect to the time that would be required when the neutral position is not changed is determined. The change of the neutral position is thus detected based on the change thus determined. As shown in FIG. 2A, the required time t2 of Case A (no change of the neutral position) (see FIG. 2C) changes to t1 or t3 of Case B or C (see FIG. 2C) according to the change of the neutral position. Therefore, the change of the neutral position can be detected based on such a change in required time.

The time required when the neutral position is not changed is defined as an initial value (reference value). The change of the neutral position is detected based on the change of the detected required time with respect to the reference value. Note that the reference value can be set in the same manner as that of the first exemplary embodiment. Regarding parameters such as a release current for displacing the exhaust valve 1 and an attracting current for attracting the exhaust valve 1, it is desirable to use preset values so that each detection operation is conducted on the same conditions, as in the first exemplary embodiment.

Figure 4:
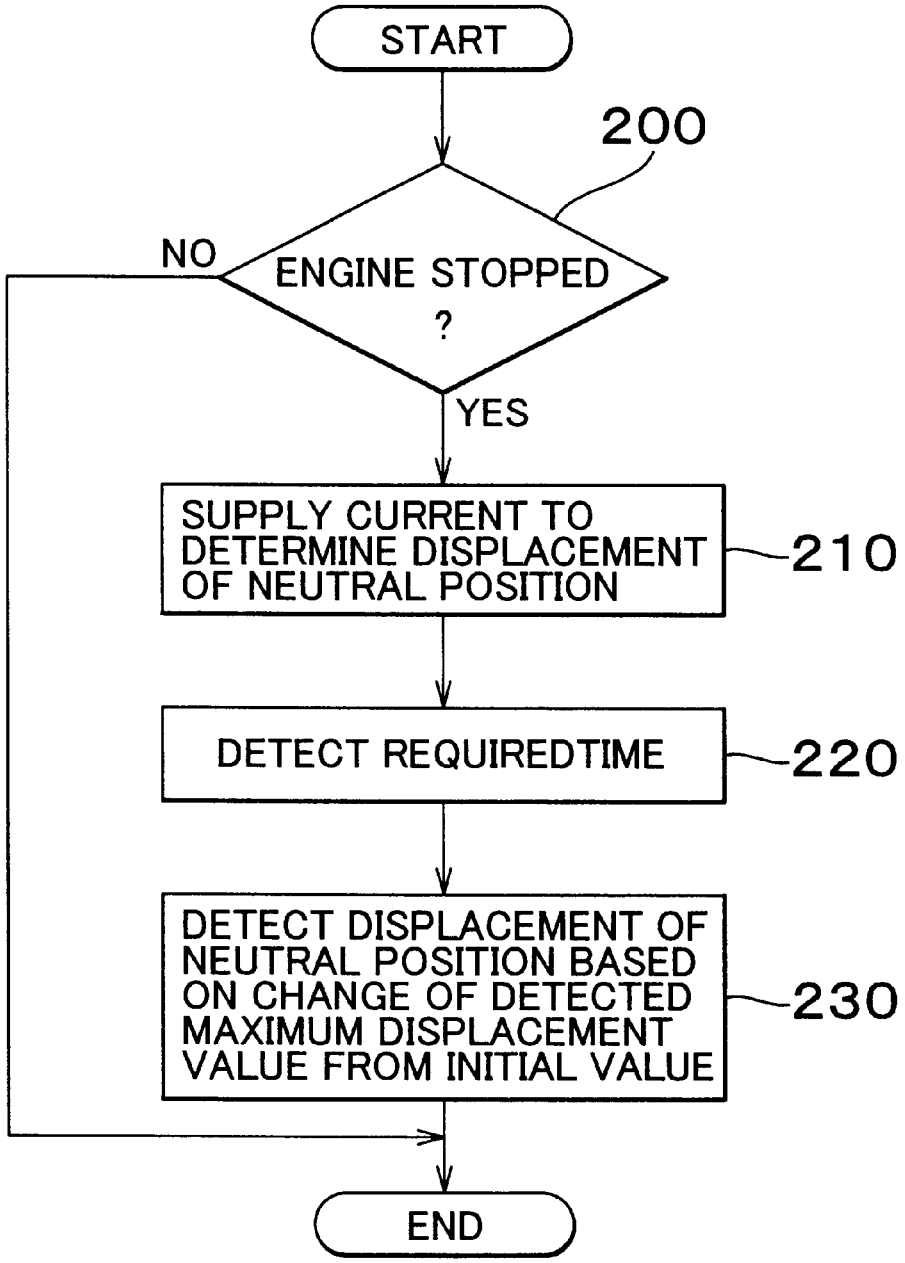
FIG. 4 is a flowchart illustrating a process of detecting the change of the neutral position of the valve in an apparatus for detecting the change of the neutral position according to a second exemplary embodiment of the invention.

The process of detecting the change of the neutral position according to the present exemplary embodiment will now be described with reference to FIG. 4. For example, this process may be repeatedly conducted at prescribed intervals.

Figure 3:
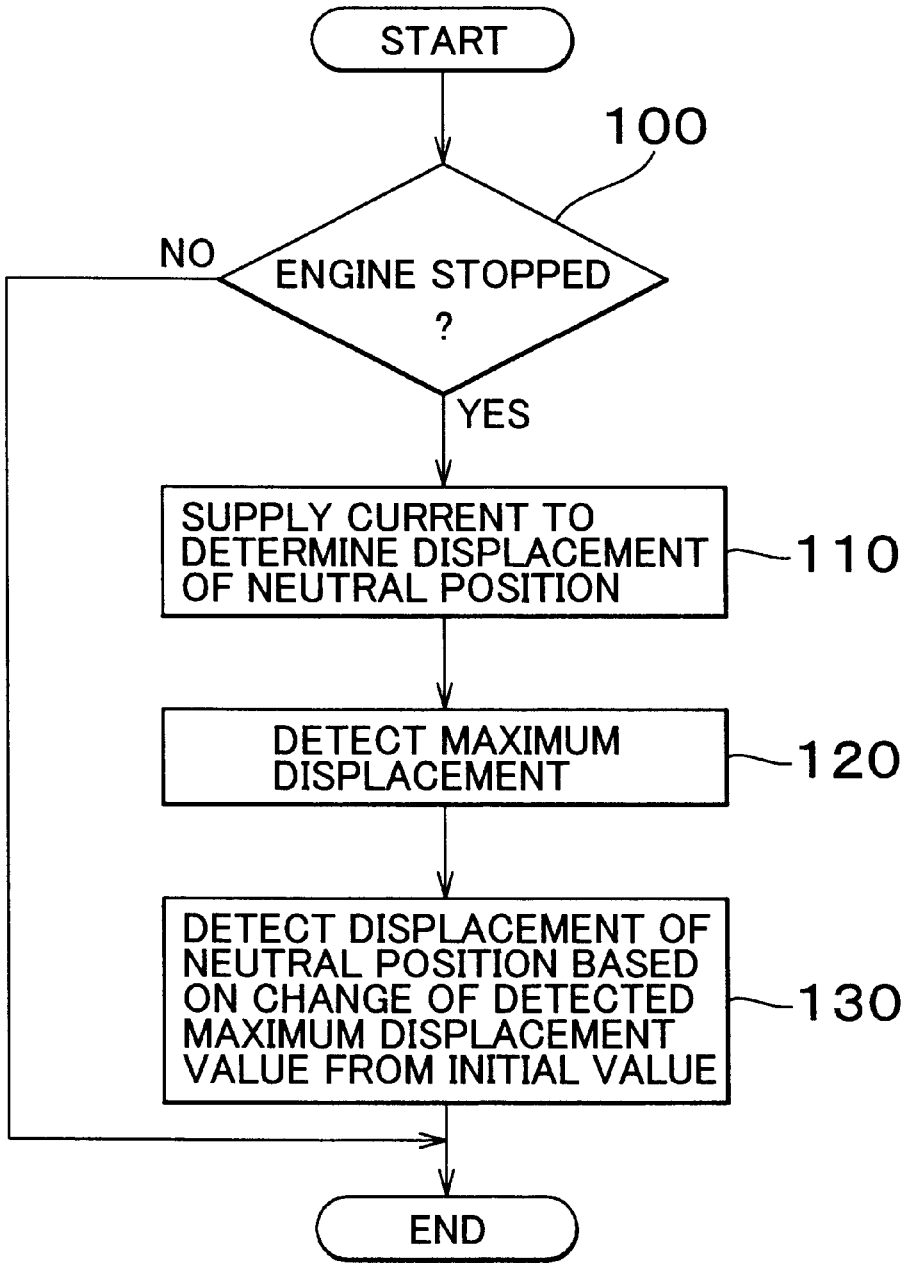
FIG. 3 is a flowchart illustrating a process of detecting the change of the neutral position according to the first exemplary embodiment.

In the series of processes, whether the engine is stopped is determined in step 200, as in step 100 of FIG. 3. If YES in step 200, the routine proceeds to step 210.

In step 210, after the exhaust valve 1 is held either at the full-open position or the full-closed position according to stop of the engine, a release current is supplied to one of the two electromagnets corresponding to that position in order to release the exhaust valve 1 therefrom. The exhaust valve 1 is displaced in response to the release current. After a prescribed time from the start of displacement of the exhaust valve 1, the exhaust valve 1 is returned back to the original position (i.e., the position where the exhaust valve 1 was held before being released). The time required for the exhaust valve 1 to return to the original position is detected (step 220), and the change of the neutral position is detected based on the change of the detected required time with respect to the initial value (step 230).

For example, a starting time of the required time may be defined as the start or end of supply of the release current, or the time when the exhaust valve 1 starts to be displaced from the full-closed position or the full-open position.

In the present exemplary embodiment as well, the effects corresponding to the effects (1) to (4) of the first exemplary embodiment can be obtained.

Third Exemplary Embodiment

Hereinafter, an apparatus for detecting a change of a neutral position of a valve of an electromagnetic valve actuation system according to the third exemplary embodiment of the invention will be described with reference to the accompanying drawings. The third exemplary embodiment will be described mainly for the differences from the first and second exemplary embodiments.

In the first exemplary embodiment, the exhaust valve 1 held at the full-closed position or the full-open position is first released. The exhaust valve 1 is then attracted back to that position, and the change of the neutral position is detected based on the displacement pattern of the exhaust valve 1.

In the present exemplary embodiment, the exhaust valve 1 held at the full-closed position or the full-open position is released and attracted to the opposite position. The change of the neutral position is detected based on the displacement pattern of the exhaust valve 1.

More specifically, the time required for exhaust valve 1 to reach the opposite position after being released is measured as a displacement pattern of the exhaust valve 1. On the basis of the detected required time, it is determined whether the detected required time changes from the time that would be required when the neutral position is not changed. The change of the neutral position is detected based on the change thus determined.

Hereinafter, the detection of the change of the neutral position according to the present exemplary embodiment will be specifically described with reference to FIGS. 5A to 5C.

For example, it is herein assumed that the exhaust valve 1 is held at the full-closed position when the engine is stopped. In this case, a release current is first supplied to the second electromagnet 38*e* (FIG. 5B) in order to release the armature 34 from the magnetic force of the permanent magnet 38*m* that attracts the armature 34 toward the upper core 38. The armature 34 (the exhaust valve 1) is thus displaced in the valve-opening direction by the urging force of the upper spring 24. After a prescribed time from a supply of the release current, an attracting current is supplied to the first electromagnet 36*e* (FIG. 5C) in order to attract the exhaust valve 1 toward the full-open position. Note that the current supplying pattern to the electromagnets 36*e*, 38*e* (such as magnitude of the release current of FIG. 5B and the attracting current of FIG. 5C and timing of supplying them) is preset so that each detection operation can be conducted on the same conditions.

The displacement pattern of the exhaust valve 1 from the full-closed position to the full-open position differs depending on whether the neutral position is changed. In FIG. 5A, the curve shown by solid line represents the displacement pattern of the case where the neutral position is not changed, as in Case A of FIG. 2C. The curve shown by dashed line represents the displacement pattern of the case where the neutral position is changed in the valve-closing direction, as in Case B of FIG. 2C. As shown in the figure, when the exhaust valve 1 is displaced from the full-closed position to the full-open position by a prescribed command current, the displacement pattern of the exhaust valve 1 changes according to the change of the neutral position. Therefore, the time required for the exhaust valve 1 to reach the full-open position also changes correspondingly. Accordingly, the change of the neutral position can be detected based on the change of the detected required time with respect to the time required when the neutral position is not changed (reference value) as shown by $\Delta t$ (the difference between the detected required time and the reference value) in FIG. 5A.

Note that the above reference value is obtained in the same manner as that of the first exemplary embodiment. The required time may be detected from the same timing as that in the second exemplary embodiment.

According to the present exemplary embodiment, the following effect is obtained in addition to those corresponding to the effects (2) to (4) of the first exemplary embodiment.

Also, (5) the exhaust valve 1 held at the full-closed position or the full-open position is released and attracted to the opposite position. The time required for the exhaust valve 1 to reach the opposite position is measured, and the change of the neutral position is detected based on the measured required time. This enables the change of the neutral position to be known even when the exhaust valve 1 does not stand still at the neutral position.

Other Exemplary Embodiments

The displacement pattern of the exhaust valve 1 that is detected to detect the change of the neutral position is not limited to those described in the above exemplary embodiments. For example, the following parameters may be used as the displacement pattern of the exhaust valve 1: the displacement rate of the exhaust valve 1 when the exhaust valve 1 is displaced from the original position (full-closed position or full-open position) by a prescribed amount; the displacement amount of the exhaust valve 1 from the original position (full-closed position or the full-open position) at a prescribed rate of the exhaust valve 1; and at least one of the displacement amount from the original position (full-closed position or full-open position) and the displacement rate of the exhaust valve 1 at a prescribed time. In this case as well, the exhaust valve 1 held at either the full-open position or the full-closed position is released and then attracted back to that position according to a preset controlling pattern (such as a command current). This enables accurate detection of the change of the neutral position as in the above exemplary embodiments.

In the above exemplary embodiments and modified exemplary embodiments thereof, the operation of releasing the exhaust valve 1 held at either the full-open position or the full-closed position is released and then attracting it to either the full-open position or the full-closed position once, and the change of the neutral position is detected based on the resultant displacement pattern of the exhaust valve 1. However, it is also possible to both release the exhaust valve 1 held at the full-closed portion and attract it to the full-open position, and also to release the exhaust valve 1 held at the full-open position and attract it to the full-closed portion. In this case, the change of the neutral position is detected in view of the asymmetry between the respective displacement patterns. The operation of releasing the exhaust valve 1 from each of the above two positions and attracting it to the other position is desirably conducted either on the same conditions or basically on the same conditions with correction of the influences of the external environment such as gravity. This enables the change of the neutral position to be detected with high accuracy in view of the influences of change in displacement pattern caused by factors other than the change of the neutral position. Note that, regarding the external environment, evaluating the measured displacement pattern of the valve in view of the influences of the external environment rather than correcting the controlling pattern of the valve, i.e. the control for releasing and attracting the exhaust valve 1, in view of the influences of the external environment would simplify the process of detecting the change of the neutral position in view of the influences of the external environment.

An example of such detection will now be described with reference to FIGS. 5A to 5C. In the illustrated example, the exhaust valve 1 held at each of the full-open position is released and the full-closed position is released in the same manner as that described in the second exemplary embodiment.

Figure 5A:
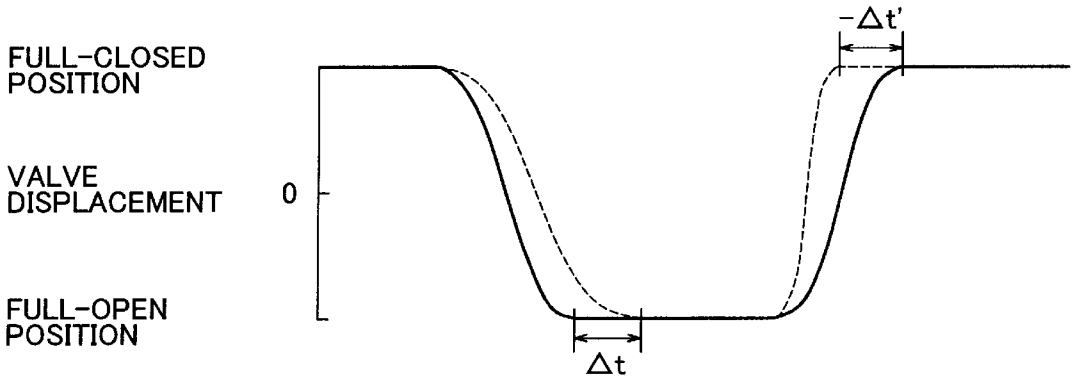
FIG. 5A exemplarily shows a displacement pattern of the valve that is obtained to detect the change of the neutral position of the valve in an apparatus for detecting the change of the neutral position of a valve of an electromagnetic valve actuation system according to a third exemplary embodiment of the invention.
Figure 5B:
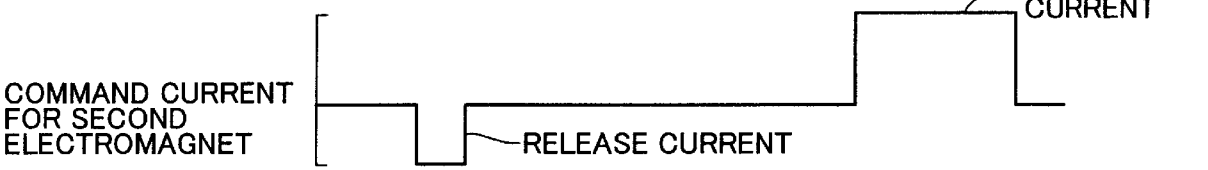
FIG. 5B shows a command current supplied to an electromagnet for driving the valve in the valve-closing direction to detect the change of the neutral position of the valve in the third exemplary embodiment.
Figure 5C:
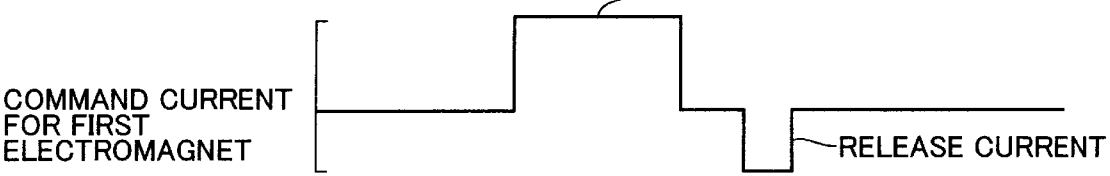
FIG. 5C shows a command current supplied to an electromagnet for driving the valve in the valve-opening direction to detect the change of the neutral position of the valve in the third exemplary embodiment.

It is now assumed that the exhaust valve 1 is held at the full-closed position when the engine is stopped, as shown in FIG. 5A. In this case, the exhaust valve 1 is first displaced to the full-open position by supplying the release current of FIG. 5B and the attracting current of FIG. 5C to the electromagnets 38*e*, 36*e*, respectively. The exhaust valve 1 is then displaced back to the full-closed position by supplying the release current of FIG. 5C and the attracting current of FIG. 5B to the electromagnets 36*e*, 38*e*, respectively. If the neutral position is changed in the valve-closing direction, the time required to displace the exhaust valve 1 from the full-closed position to the full-open position is increased by Δt with respect to the reference value, as shown by dashed line in FIG. 5A. Moreover, the time required to displace the exhaust valve 1 from the full-open position to the full-closed position is reduced by Δt' with respect to the reference value. If Δt is extremely smaller than Δt', the change of the detected required time with respect to the reference value is considered to be caused by increase in sliding resistance during displacement of the exhaust valve 1 rather than by the change of the neutral position. In this case, by considering the asymmetry between the time required to displace the exhaust valve 1 from the full-closed position to the full-open position and the time required to displace the exhaust valve 1 from the full-open position to the full-closed position, the change of the neutral position can be detected with improved accuracy in view of the influences such as the sliding resistance. Alternatively, the exhaust valve 1 held at the full-open position may be released and be attracted to the full-closed portion, then the exhaust valve 1 held at the full-closed portion may be released and be attracted to the full-open position.

In the above exemplary embodiments, the change of the neutral position is detected when the engine is stopped. However, the invention is not limited to this. For example, the change of the neutral position may alternatively be detected when the engine is started. In this case, it is desirable to detect the change of the neutral position in response to turning-ON of an ignition switch or starter switch before the starter is actuated.

It is preferable that the exhaust valve 1 be controlled based on a difference between a value representing a current neutral position among parameter values representing a displacement pattern of the exhaust valve 1 and a reference value i.e., a value, representing a neutral position when the neutral potion is not changed.

For example, in the first exemplary embodiment, it is preferable that the exhaust valve 1 be controlled based on a difference between the detected maximum displacement amount and a reference value i.e., the maximum displacement amount when the neutral potion is not changed.

In the second exemplary embodiment, it is preferable that the exhaust valve 1 be controlled based on a difference (i.e. t2-t1 or t2-t3) between the detected required time and a reference value of the required time, i.e., the required time when the neutral potion is not changed.

In the third exemplary embodiment, it is preferable that the exhaust valve 1 be controlled based on a difference (i.e. Δt) between the detected required time and a reference value of the required time, i.e., the required time when the neutral potion is not changed.

Also, it is possible to estimate the current neutral position of the exhaust valve 1 based on at least one of these differences. Further, it is preferable that the exhaust valve 1 be controlled based on the estimated current neutral position.

The ECU 40 may control the exhaust valve 1 based on the difference or the estimated current neutral position. However, in other exemplary embodiments, another ECU 40A may control the exhaust valve 1 based on the difference or the estimated current neutral position.

The electromagnetic valve actuation system of the above exemplary embodiments is an electromagnetic engine valve of the internal combustion engine. However, the electromagnetic valve actuation system may be an electromagnetic valve actuation system of any other devices. The invention may be applied to any electromagnetic valve actuation system which drives a valve such that the valve is placed in an open portion and a closed portion by the electromagnetic force of electromagnets, the valve being urged to the neutral position (the position where the urging forces are balanced) by the respective urging forces of urging members for urging the valve in the valve-opening and valve-closing directions.

In the electromagnetic valve actuation system, a holding device that holds the valve at the full-open position or the full-closed position when the electromagnetic force is not generated is not limited to the permanent magnets arranged in the aforementioned manner. The holding device may be any device such as an appropriate regulating member.

Detection of the neutral position according to the invention can be realized even with an electromagnetic valve actuation system whose valve may stand still at the neutral position.

The urging members for urging the valve in the valve-opening and valve-closing directions are not limited to springs, and any urging members may be used. Examples of the urging members include an air spring having compressed air charged between cylinder and piston. Note that such urging members are desirably formed as elastic members.

The controllers (e.g., the ECU 40 and the ECU 40A) of the illustrated exemplary embodiments are implemented as one or more programmed general purpose computers. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more less or only a single element, are also within the spirit and scope of the invention.

What is claimed is:

1. An apparatus for detecting a change of a neutral position of a valve of an electromagnetic valve actuation system, the valve being urged to the neutral position by urging forces of urging members for urging the valve in valve-opening and valve-closing directions, the neutral position being a position where the urging forces are balanced, the apparatus comprising:

an electromagnet that drives the valve in the valve-opening and the valve-closing directions by an electromagnetic force; and a first controller that releases the valve held at one of a first terminal position in a closed position side and a second terminal position in an open position side, then attracts the valve to one of the terminal positions by supplying a current to the electromagnet and detects the change of the neutral position based on a parameter that represents a displacement pattern of the valve obtained by displacing the valve.

2. The apparatus according to claim 1, wherein the first controller releases the valve and then attracts the valve back to the terminal position at which the valve was held before being released, and wherein the first controller measures a maximum displacement amount of the valve from the terminal position before being released as the parameter and detects the change of the neutral position based on a change of the measured maximum displacement amount with respect to a reference value.

3. The apparatus according to claim 1, wherein the first controller releases the valve and then attracts the valve back to the terminal position at which the valve was held before being released, and wherein the first controller measures a time required for the valve to return to the terminal position after being released therefrom to the terminal position before being released as the parameter and detects the change of the neutral position based on a change of the measured required time from a reference value.

4. The apparatus according to claim 1, wherein the first controller releases the valve from one of the terminal positions and attracts the valve to the other terminal position, and wherein the first controller measures a time required for the valve to reach the other terminal position after being released as the parameter and detects the change of the neutral position based on a change of the measured required time with respect to a reference value.

5. The apparatus according to claim 1, wherein the first controller releases the valve held at the first terminal position in the closed position side and attracts it to the second terminal position in the open position side, and releases the valve held at the second terminal position in the open position side and attracts it to the first terminal position in the closed position side, and wherein the first controller detects the change of the neutral position in view of asymmetry between a displacement pattern of the valve obtained by releasing the valve from the first terminal position and a displacement pattern of the valve obtained by releasing the valve from the second terminal position.

6. The apparatus according to claim 1, wherein the valve is an engine valve of an internal combustion engine and is held at one of the terminal positions when the engine is stopped and the first controller supplies a current to the electromagnet when the engine is stopped or started.

7. The apparatus according to claim 1, wherein the first controller calculates a difference between a value representing a current neutral position among values of the parameter and a reference value.

8. An electromagnetic valve actuation system, comprising:

the apparatus for detecting the change of the neutral position according to claim 7; and a second controller that controls the valve based on the calculated difference.

9. The apparatus according to claim 1, wherein the first controller measures the parameter and estimates the current neutral position of the valve based on the measured parameter.

10. An electromagnetic valve actuation system, comprising:

the apparatus for detecting the change of the neutral position according to claim 9; and a second controller that controls the valve based on the estimated current neutral position.

11. A method for detecting a change of a neutral position of a valve of an electromagnetic valve actuation system, comprising:

releasing the valve held at one of a first terminal position in a closed position side and a second terminal position in an open position side;

attracting the valve to one of the terminal positions by supplying a current to an electromagnet of the electromagnetic valve actuation system;

measuring a parameter that represents a displacement pattern of the valve obtained by displacing the valve; and detecting the change of the neutral position based on the measured parameter.

12. The method according to claim 11, wherein the valve is released from the terminal position and then attracted back to the terminal position at which the valve was held before being released, a maximum displacement amount of the valve from the terminal position before being released is measured as the parameter and the change of the neutral position is detected based on a change of the maximum displacement amount with respect to a reference value.

13. The method according to claim 11, wherein the valve is released from the terminal position and then attracted back to the terminal position at which the valve was held before being released, a time required for the valve to return to the terminal position before being released after being released therefrom is measured as the parameter and the change of the neutral position is detected based on a change of the required time with respect to a reference value.

14. The method according to claim 11, wherein the valve is released from one of the terminal positions and attracted to the other terminal position, a time required for the valve to reach the other terminal position after being released is measured as the parameter and the change of the neutral position is detected based on a change of the required time with respect to a reference value.

15. The method according to claim 11, wherein: the valve held at the first terminal position in the closed position side is released and then attracted to the second terminal position in the open position side, and the valve held at the second terminal position in the open position side is released and then attracted to the first terminal position in the closed position side; and the change of the neutral position is detected in view of asymmetry between a displacement pattern of the valve obtained by releasing the valve from the second terminal position and a displacement pattern of the valve obtained by releasing the valve from the first terminal position.

16. The method according to claim 11, wherein the change of the neutral position of the valve is detected when the engine is stopped or started.

17. The method according to claim 11, further comprising:

calculating a difference between a value representing a current neutral position among values of the measured parameter and a reference value.

18. A method of controlling the valve, comprising:

controlling the valve based on the calculated difference according to claim 17.

19. The method according to claim 11, further comprising:

estimating the current neutral position of the valve based on the measured parameter.

20. A method of controlling the valve, comprising:

controlling the valve based on the estimated current neutral position according to claim 19.

* * * * *